US008899460B2

(12) United States Patent
Wojcicki

(10) Patent No.: US 8,899,460 B2
(45) Date of Patent: Dec. 2, 2014

(54) MAGAZINE ASSEMBLY FOR NAILER

(75) Inventor: Andrzej R. Wojcicki, Rosedale, MD (US)

(73) Assignee: Black & Decker Inc., Newark, DE (US)

( * ) Notice: Subject to any disclaimer, the term of this patent is extended or adjusted under 35 U.S.C. 154(b) by 189 days.

(21) Appl. No.: 12/119,062

(22) Filed: May 12, 2008

(65) Prior Publication Data

US 2008/0308597 A1 Dec. 18, 2008

Related U.S. Application Data

(60) Provisional application No. 60/943,325, filed on Jun. 12, 2007.

(51) Int. Cl.
*B25B 5/16* (2006.01)
*B25C 1/00* (2006.01)

(52) U.S. Cl.
CPC ..... *B25C 1/005* (2013.01)
USPC ..... 227/126; 227/119; 227/120; 227/125

(58) Field of Classification Search
USPC ..... 227/8, 119, 120, 125, 139, 126
See application file for complete search history.

(56) References Cited

U.S. PATENT DOCUMENTS

| | | | | |
|---|---|---|---|---|
| 2,263,293 | A | | 11/1941 | Ewald |
| 2,664,565 | A | | 1/1954 | Percoco |
| 2,973,978 | A | | 3/1961 | Oppenheim |
| 3,174,672 | A | | 3/1965 | Juilfs |
| 3,615,049 | A | | 10/1971 | Obergfell et al. |
| 3,632,121 | A | | 1/1972 | Wahlmark |
| 3,992,596 | A | | 11/1976 | Miller |
| 4,197,974 | A | | 4/1980 | Morton et al. |
| 4,389,012 | A | | 6/1983 | Grikis et al. |
| 4,483,473 | A | | 11/1984 | Wagdy |
| 4,558,811 | A | * | 12/1985 | Klaus ..... 227/116 |
| 4,624,401 | A | | 11/1986 | Gassner et al. |
| 4,688,710 | A | | 8/1987 | Massari, Jr. et al. |
| 4,717,060 | A | | 1/1988 | Cotta |
| 4,801,062 | A | * | 1/1989 | Austin ..... 227/128 |
| 4,815,647 | A | * | 3/1989 | Chou ..... 227/109 |
| 5,110,030 | A | | 5/1992 | Tanji et al. |
| 5,163,596 | A | * | 11/1992 | Ravoo et al. ..... 227/109 |
| 5,197,647 | A | | 3/1993 | Howell |
| 5,297,713 | A | * | 3/1994 | Perra et al. ..... 227/123 |

(Continued)

FOREIGN PATENT DOCUMENTS

| | | |
|---|---|---|
| DE | 1503051 | 7/1970 |
| DE | 7916804 | 8/1980 |

(Continued)

OTHER PUBLICATIONS

European Search Report Application No. EP 08 15 8158 dated Jul. 29, 2010.

*Primary Examiner* — Gloria R Weeks
(74) *Attorney, Agent, or Firm* — Harness, Dickey & Pierce, P.L.C.

(57) ABSTRACT

A cordless nailer is provided having a magazine assembly with improved features. A pusher assembly is provided having a simplified and efficient construction. A pusher retention feature is provided that prevents the driver blade from impacting a nail pusher. A nail retention feature is provided to allow easy loading and unloading of nails into the nailer. Finally, a method of assembling the magazine assembly is provided.

4 Claims, 6 Drawing Sheets

(56) References Cited

U.S. PATENT DOCUMENTS

| | | | | |
|---|---|---|---|---|
| 5,322,189 | A * | 6/1994 | Oda | 221/227 |
| 5,335,800 | A * | 8/1994 | Liu | 221/279 |
| 5,632,431 | A * | 5/1997 | Lin | 227/109 |
| 5,715,986 | A | 2/1998 | Sauer et al. | |
| 5,813,588 | A * | 9/1998 | Lin | 227/109 |
| 5,873,509 | A * | 2/1999 | Liao | 227/109 |
| 5,975,399 | A * | 11/1999 | Oehri et al. | 227/120 |
| 6,012,622 | A | 1/2000 | Weinger et al. | |
| 6,036,072 | A | 3/2000 | Lee et al. | |
| 6,056,181 | A * | 5/2000 | Chuang | 227/8 |
| 6,076,721 | A * | 6/2000 | Yang | 227/120 |
| 6,161,746 | A * | 12/2000 | Wey | 227/109 |
| 6,199,739 | B1 * | 3/2001 | Mukoyama et al. | 227/8 |
| 6,290,115 | B1 * | 9/2001 | Chen | 227/120 |
| 6,296,167 | B1 | 10/2001 | Jen et al. | |
| 6,431,429 | B1 | 8/2002 | Canlas et al. | |
| 6,592,014 | B2 | 7/2003 | Smolinski | |
| 6,648,202 | B2 | 11/2003 | Miller et al. | |
| 6,695,197 | B2 * | 2/2004 | Johansson | 227/138 |
| D500,655 | S | 1/2005 | Leasure | |
| 6,923,272 | B2 | 8/2005 | Jansson et al. | |
| 6,974,067 | B2 * | 12/2005 | Chen | 227/120 |
| 7,111,364 | B2 | 9/2006 | Bader et al. | |
| 7,137,540 | B2 | 11/2006 | Terrell et al. | |
| 7,641,089 | B2 * | 1/2010 | Schell et al. | 227/120 |
| 8,690,036 | B2 * | 4/2014 | Schell et al. | 227/8 |
| 2002/0117531 | A1 * | 8/2002 | Schell et al. | 227/8 |
| 2003/0201299 | A1 * | 10/2003 | Chen | 227/109 |
| 2004/0211810 | A1 * | 10/2004 | Ho et al. | 227/120 |
| 2005/0001007 | A1 | 1/2005 | Butzen et al. | |
| 2005/0001008 | A1 | 1/2005 | Sun | |
| 2005/0121488 | A1 * | 6/2005 | Sun | 227/109 |
| 2005/0218175 | A1 * | 10/2005 | Schell et al. | 227/8 |
| 2006/0016843 | A1 | 1/2006 | Ishizawa et al. | |
| 2006/0091168 | A1 | 5/2006 | Ng | |
| 2006/0104735 | A1 | 5/2006 | Zeiler et al. | |
| 2007/0267457 | A1 * | 11/2007 | Adachi | 227/129 |
| 2008/0023517 | A1 * | 1/2008 | Wojcicki | 227/120 |
| 2008/0257932 | A1 * | 10/2008 | Nagata | 227/120 |

FOREIGN PATENT DOCUMENTS

| | | |
|---|---|---|
| DE | 19707235 | 8/1998 |
| EP | 0100105 | 2/1984 |
| EP | 0951965 | 10/1999 |
| EP | 1231028 A2 | 8/2002 |

* cited by examiner

MAGAZINE ASSEMBLY FOR NAILER

CROSS-REFERENCE TO RELATED APPLICATIONS

This application claims the benefit of U.S. Provisional Application No. 60/943,325, filed Jun. 12, 2007. The disclosure of the above application is incorporated herein by reference.

FIELD OF THE INVENTION

The present invention relates to a nailer, and more particularly to a magazine assembly for a nailer.

BACKGROUND OF THE INVENTION

Fastening tools, such as power nailers and staplers, are relatively commonplace in the construction trades. Often times, however, the fastening tools that are available may not provide the user with a desired degree of flexibility and freedom due to the presence of hoses and such that couple the fastening tool to a source of pneumatic power. Similarly, many features of typical fasteners, while adequate for their intended purpose, do not provide the user with the most efficient and effective function. Accordingly, there remains a need in the art for an improved fastening tool.

SUMMARY OF THE INVENTION

A nailer is provided having a magazine assembly with improved features. An improved latch mechanism for clearing nail jams is provided that reduces wear on the latch. A pusher assembly is provided having a simplified and efficient construction. A pusher retention feature is provided that allows the pusher assembly to move behind nails loaded in the magazine assembly. A nail retention feature is provided to allow easy loading and unloading of nails into the nailer.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
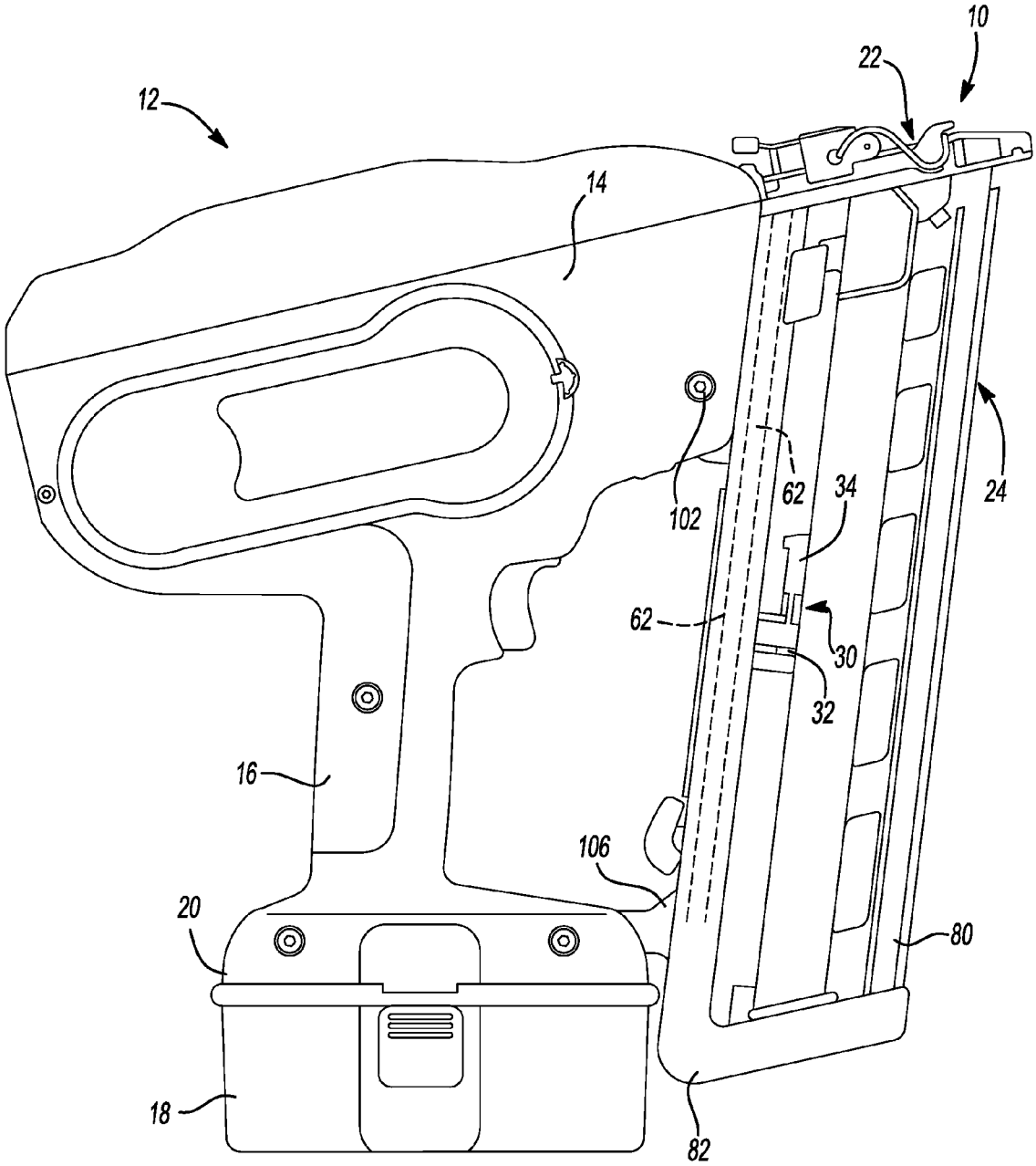
FIG. 1 is a side view of an exemplary nailer having a magazine assembly constructed according to the principles of the present invention.
Figure 1A:
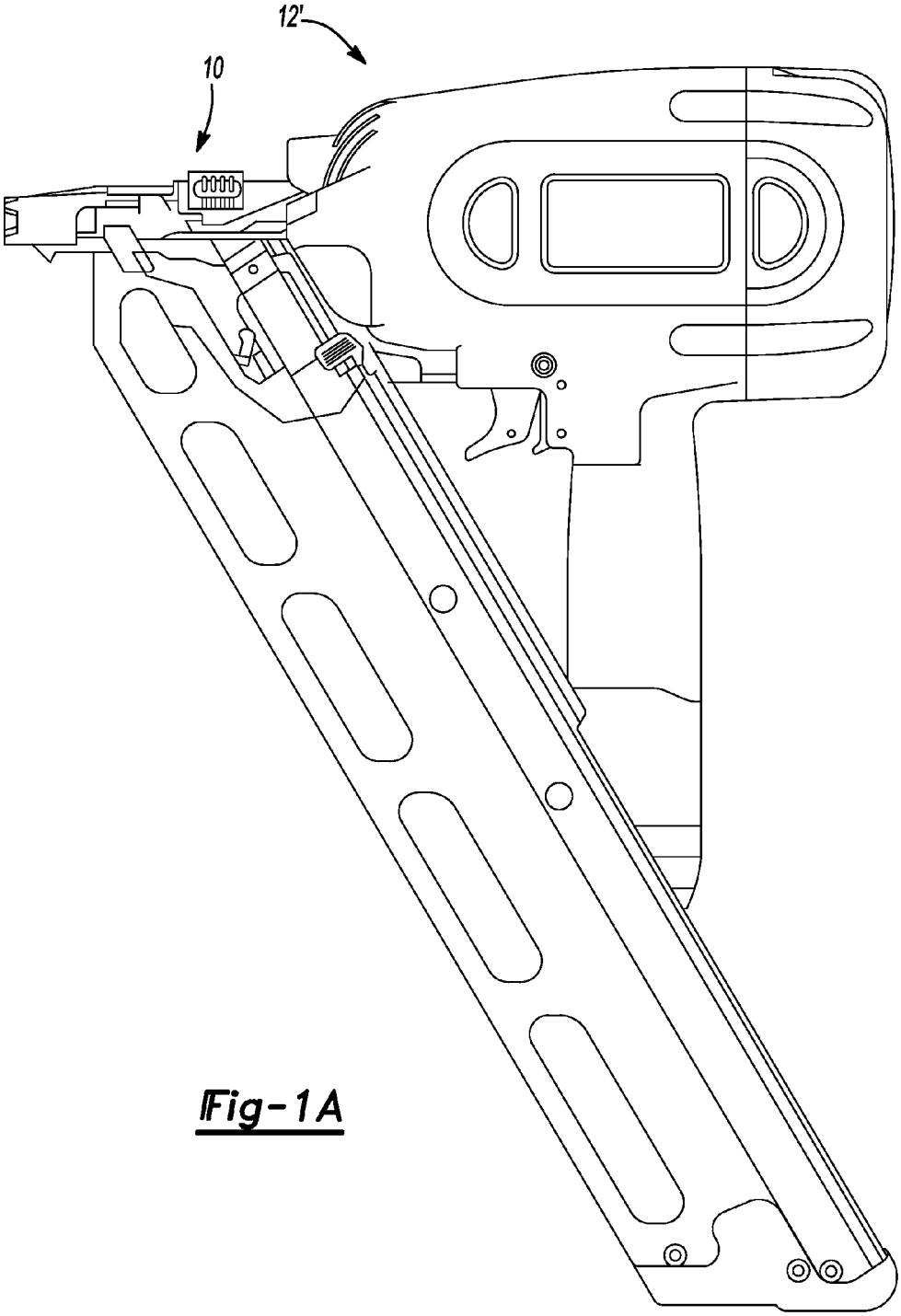
FIG. 1A is a side view of an exemplary pneumatic nailer having a magazine assembly constructed according to the principles of the present invention.

With reference to FIG. 1, a magazine assembly 10 constructed according to the principles of the present invention is shown in operative association with an exemplary cordless nailer 12. It should be appreciated, however, that the present invention may be employed with various other nailers. By way of example, a pneumatic nailer 12' is shown in FIG. 1A, in which the magazine assembly 10 can be incorporated. The cordless nailers 12, 12' generally include a housing 14 with either a motor or pneumatically driven nail driving mechanism located therein. The nail driving mechanism drives nails (not shown) from the magazine assembly 10, as is well known in the art. A handle 16 extends from the housing 14 and terminates in a battery pack 18. The battery pack 18 is configured to engage a base portion 20 of the handle 16 and provides power to the motor.

The magazine assembly 10 includes a nosepiece assembly 22 and a magazine 24. The nosepiece assembly 22 is mounted to the housing 14. The magazine 24 is coupled to the nosepiece assembly 22 at one end thereof and is mounted to the base 20 of the handle 16 at an opposite end thereof.

Referring again to FIG. 1, the magazine 24 holds a plurality of nails (not shown) therein. The nails are fed forward into the nosepiece assembly 22 by a pusher assembly 60. The pusher assembly 60 rides within the magazine 24 and protrudes partially therefrom to be engaged by the operator of the nailer 12.

Figure 3A:
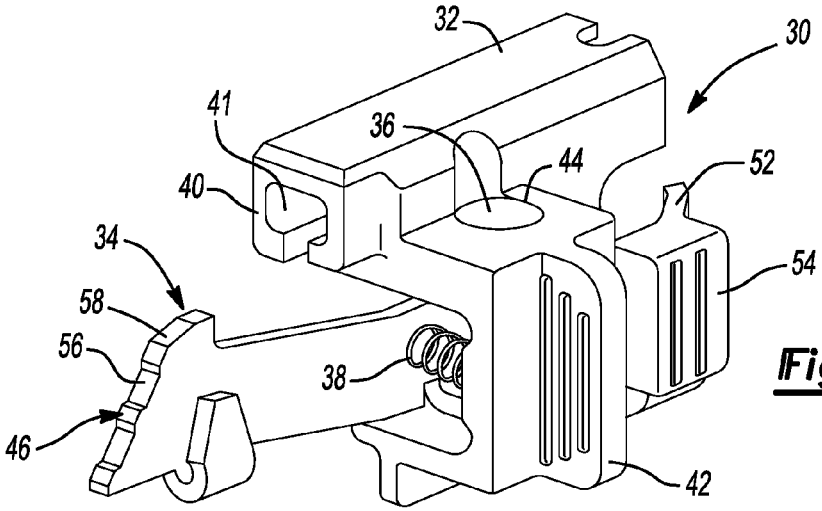
FIG. 3A is a perspective view of a nail pusher used with the magazine assembly of the present invention.
Figure 3B:
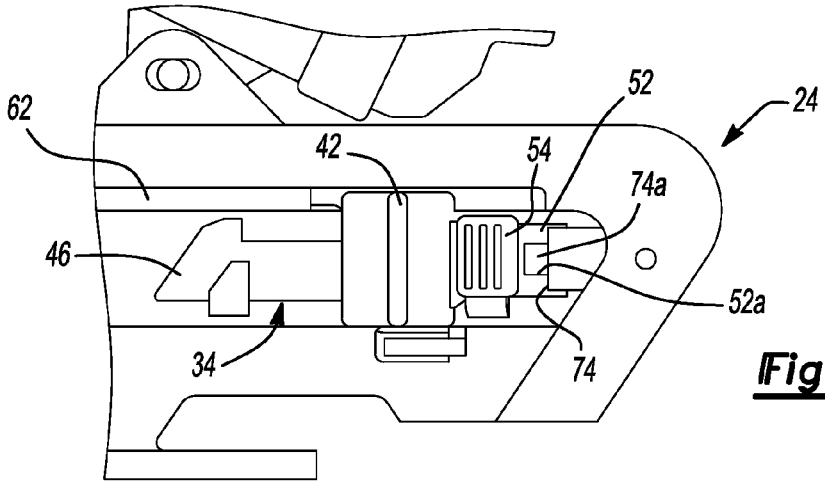
FIG. 3B is a side view of the nail pusher of FIG. 3A assembled to a magazine.
Figure 3C:
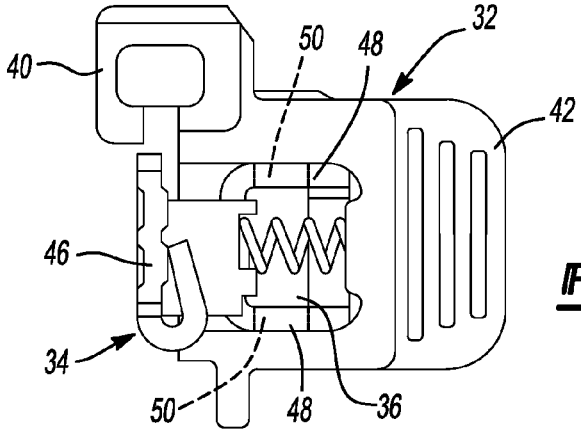
FIG. 3C is a front view of the nail pusher of FIG. 3A.

Turning to FIGS. 3A, 3B and 3C, the pusher assembly 30 includes a carrier 32, a pusher 34 pivotally mounted to the carrier 32 by a pivot pin 36 and a spring member 38. The carrier 32 includes a runner portion 40 having a channeled portion 41 sized to fit and slide on a liner (described in detail herein below) of the magazine 24 (FIG. 1). A handle 42 extends out from the runner portion 40 and out from the magazine 24, as shown in FIG. 3B. The pivot pin 36 is received in support holes 44 provided in the handle portion 42 of the carrier 32. The carrier 32 is a one piece unitary structure.

The pusher 34 includes a front nail engaging portion 46 that engages the nails (not shown) to move them towards the nosepiece assembly 22 (FIG. 1). The pusher 34 includes a pair of flanges 48 each having a pivot hole 50 sized to receive the pivot pin 36 therein for pivotally connecting the pusher 34 to the carrier 32. An arm 52 extends out from the pusher 34 on an opposite side of the pivot pin from the nail engaging portion 46. A grip 54 can be mounted to the arm 52

The nail engaging portion 46 of the pusher 34 includes a first surface 56 configured to engage nails and a second surface 58 angled with respect to the first surface 56. The second surface 58 is angled to allow a nail driver blade of the nailer 10 to strike the second surface 58, thereby moving the pusher 34 out of the way of the driver blade during a stroke of the driver blade.

With reference to FIG. 3A, a biasing member such as, for example, the spring 38 is mounted between the handle 42 and the pusher 34 to bias the pusher 34 such that the nail engaging portion 46 is biased in alignment with the nails (not shown) loaded within the magazine 24 (FIG. 1).

Turning to FIGS. 4A-D, loading and unloading of the magazine 24 will now be described. The magazine 24 includes a nail track 60 that is sized to accept a plurality of nails therein. The nails are supported on one end thereof within the liner 62 at another end thereof with a lower magazine (further described below) which forms part of the magazine 24. The nails slide up the magazine 24 towards the nosepiece assembly 22 (FIG. 1) by the pusher 34. As noted above, the pusher 34 slides along a portion of the magazine 24, specifically, along a liner 62 shown in FIG. 1.

Figure 4A:
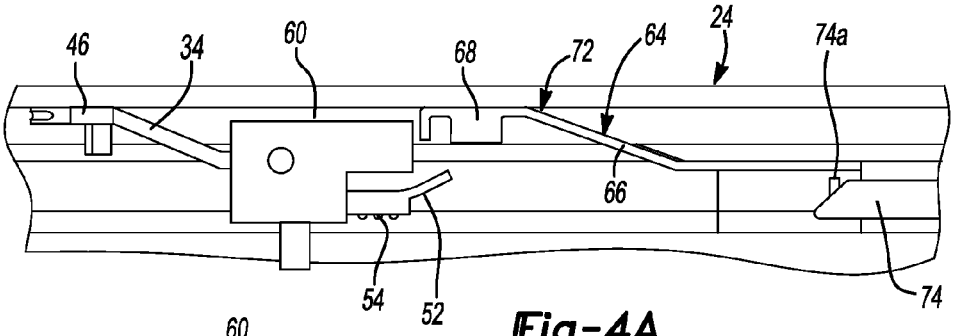
FIG. 4A is a top view of a nail retention system used in the magazine assembly of the present invention in an unlocked position.
Figure 4B:
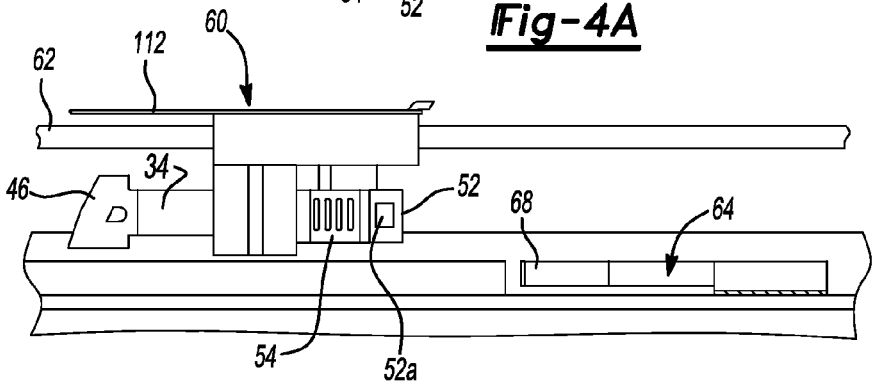
FIG. 4B is a side view of the nail retention system shown in FIG. 4A.

Nails are loaded into the nail track 60 of the magazine 24 by inserting them into the nail track 60 through an opening (not shown) in the back of magazine 24. In order to keep the nails within the nail track 60, the magazine 24 further includes a nail retaining spring 64 (FIGS. 4A and 4C) mounted therein. The nail retaining spring 64 acts as a one way valve to allow nails to enter the nail track 60 while preventing them from exiting. Specifically, the nail retaining spring 64 includes a spring arm 66 fixed to the magazine 24 at one end thereof and a head portion 68 at a free end thereof. The head portion 68 is aligned with the nail track 60 when in an unbiased condition (e.g., when the spring arm 66 has not been fully deflected from its rest position), as shown in FIG. 4A.

The spring arm 66 and the head portion 68 cooperate to form an inclined surface 72 such that nails introduced into the magazine 24 will deflect the nail retaining spring 64 out of the way. The nail retaining spring 64 then snaps back into place, thereby preventing the nails from accidentally exiting the magazine 24.

Figure 2:
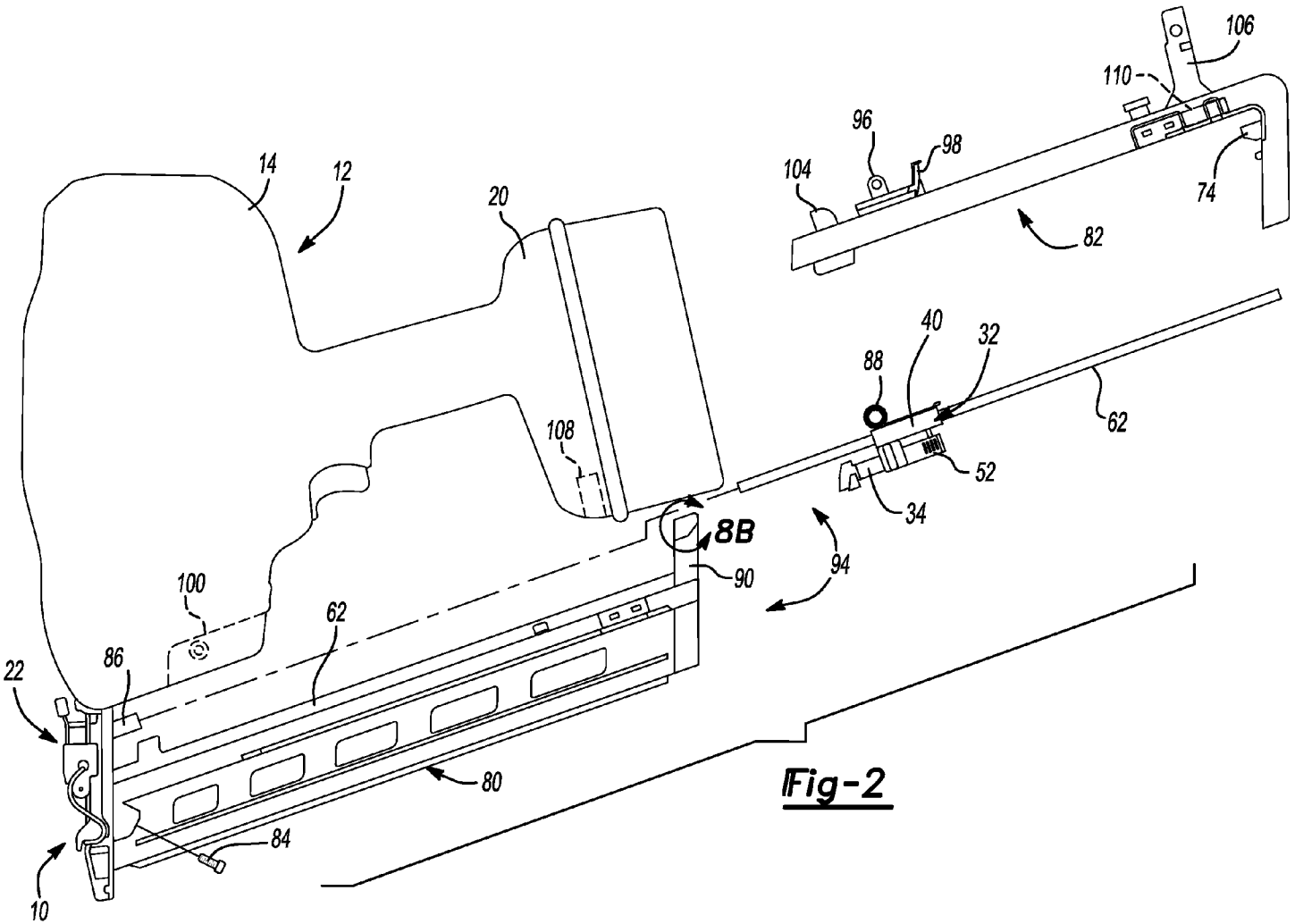
FIG. 2 is an expanded side view of the magazine assembly of the present invention illustrating a method of assembling the magazine assembly.
Figure 4C:
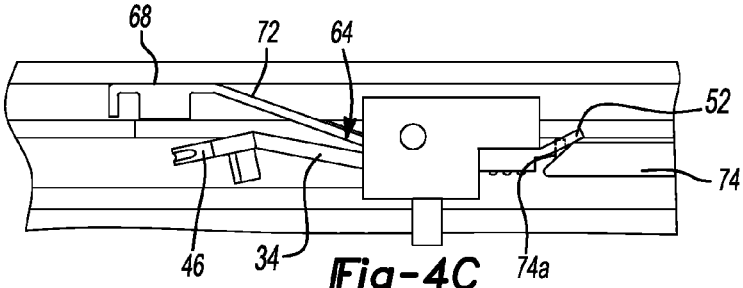
FIG. 4C is a top view of the nail retention system of FIG. 4A in a locked position.
Figure 4D:
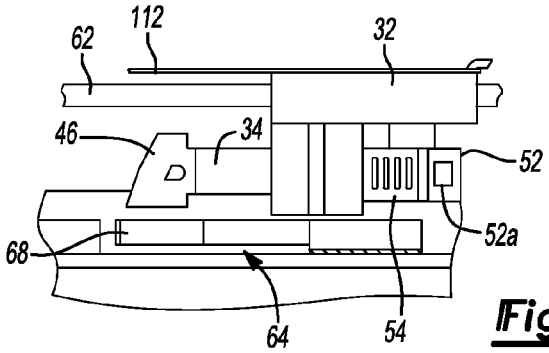
FIG. 4D is a side view of the nail retention system shown in FIG. 4C.
Figure 5A:
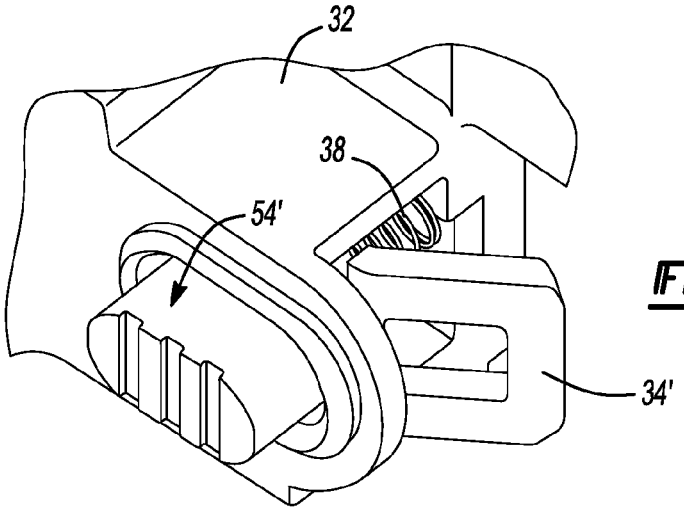
FIG. 5A is an upper rear perspective view of a nail pusher used with the magazine assembly of the present disclosure.
Figure 5B:
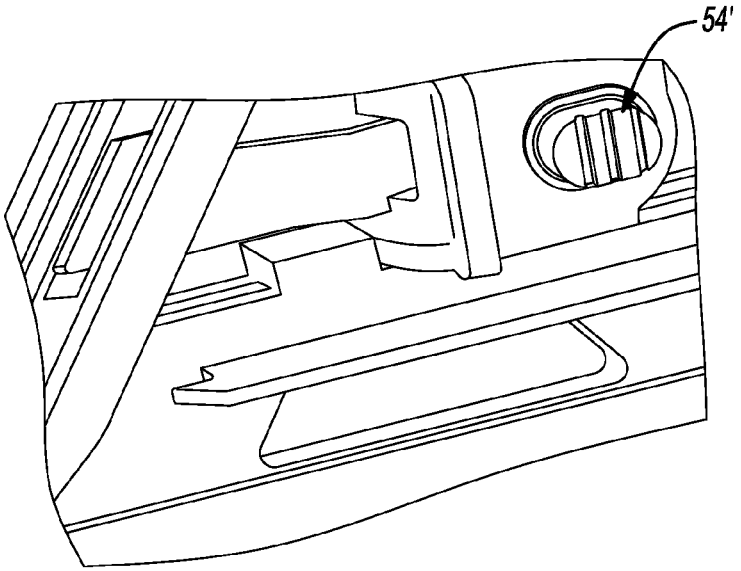
FIG. 5B is a side perspective view of the nail pusher of FIG. 5A assembled to a magazine.
Figure 5C:
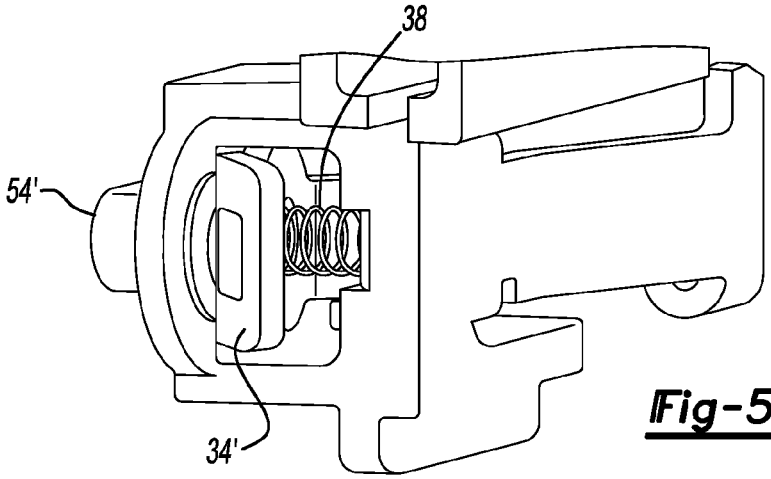
FIG. 5C is a rear perspective view of the nail pusher of FIG. 5A.

In order to load or unload the magazine 24, the pusher 34 can be moved to the back of the magazine 24. The rear arm 52 of the pusher 34 then engages a cam surface 74 (FIG. 4C) in the magazine 24 near the back thereof (specifically located on a portion of the magazine 24 as seen in FIG. 2). The rear arm 52 of the pusher 34 includes an aperture 52*a* therein, as best shown in FIG. 3B. The aperture 52*a* receives a tab 74*a* disposed adjacent to the cam surface 74. The tab 74*a* retains the arm 52 of the pusher 34 in the rearward position. The cam surface 74 and the arm 52 cooperate to rotate the pusher 34 out of alignment with the nail track 60, as seen in FIG. 4C, against the force of the spring 38. Nails may then freely exit (or enter) the nail track 60 without interference from the pusher 34. In this way, the pusher 34 cooperates with the nail retaining spring 64 to allow the magazine to be loaded in either a "load and draw" mode (e.g., wherein, nails are first inserted in the magazine 24 and then the pusher 34 is then "rotated" out of the plane of the nail track 60 upon contact with the nails and drawn behind the loaded nails) or in a "cock and load" mode (e.g., wherein, the pusher 34 is drawn to the back of the magazine 24 and cocked out of alignment with the nail track 60 by the cam surface 74 thereby allowing nails to be loaded and unloaded without restriction by the pusher 34). To disengage the pusher 34 from the tab 74*a*, the grip 54 is provided to allow the user to push the arm 52 out of engagement with the tab 74*a*. As an alternative embodiment as shown in FIGS. 5A-5C, a push button 54' can be utilized to disengage the pusher 34' from the tab 74*a*. In the embodiment shown in FIGS. 5A-5C, the spring 38 can be disposed inward from the push button 54'.

Turning now to FIG. 2, the assembly of the magazine assembly 10 will be described. The nosepiece assembly 22 is fixed to a backbone structure (not shown) within the housing 14 of the nailer 12. The magazine 24 generally includes the liner (or guide) 62, a lower magazine 80, and an upper magazine 82.

First, the lower magazine 80 is coupled to the nosepiece assembly 22 near the lower end of the nosepiece assembly 22. In the particular example provided, screws 84 are used to couple the lower magazine 80 to the nosepiece assembly 22, although various other methods may be employed.

Next, the liner 62 is inserted into a receiver 86 in the nosepiece assembly 22 from the back thereof. The carrier 32 is coupled to the liner 62 such that the runner 40 slidingly engages the liner 62. A constant force spring 88 (in the form of an axle-free rolled memory-type sheet steel) is then hooked onto the carrier 32. The constant force spring 88 engages a portion of the magazine 24 as will be described below and biases the carrier 32 and pusher 34 towards the nosepiece assembly 22. The liner 62 is then coupled to a base portion 90 on the lower magazine 80. The base portion 90 on the lower magazine 80 includes a slot for receiving an end of the liner 62 therein. The slot can include a plurality of ribs that engage the liner 62 and create a snap-fit or tight engagement therebetween. Alternatively, the base portion 90 may include a hole (not shown) sized to receive the liner 62 therein, or may include any other means of locking the liner 62 to the lower magazine 80.

The liner 62 and lower magazine 80 cooperate to form a fixed subassembly 94. The upper magazine 82 is then inserted overtop of the base portion 90 of the lower magazine 80 and overtop of the liner 62. Specifically, the upper magazine 82 includes a screw receiver 96 extending therefrom with a wall 98 formed near the screw receiver 96. The screw receiver 96 is sized to fit within an opening 100 formed in the housing 14 of the nailer 12. A screw 102, as seen in FIG. 1, extends through the housing 14 and engages the screw receiver 96, thereby securing the upper magazine 82 to the nailer 12. The wall 98 aligns with the opening 100 thereby covering the opening 100.

The upper magazine 95 further includes a spring retainer 104 extending therefrom. The spring retainer 104 has a cup shape and is sized to receive and secure the rolled portion of the constant force spring 88 therein. As the pusher 34 is drawn away from the nosepiece assembly 22, the constant force spring 88 acts to bias the pusher 34 towards the nosepiece assembly 22.

A ribbed flange 106 extends out from the upper magazine 82 and engages a matching ribbed recess 108 formed in the base 20 of the nailer 12 as the upper magazine 82 is coupled to the lower magazine 80 and the housing 14. The ribbed flange 106 lends structural support to the magazine assembly 10 when assembled. Moreover, the upper magazine 82 includes ramps 110 formed therein for aligning the liner 62 when the upper magazine 82 is coupled overtop the subassembly 94. In this way, the components of the subassembly 94 are fixed automatically during alignment thereof to reduce the number of components that must be held in place manually by an individual.

The method of assembling the magazine assembly 10 allows a user to quickly and efficiently do so by creating subassemblies which aid alignment. Moreover, engagement of the parts of the magazine 24 within receivers and apertures allows for quick and easy alignment of the parts.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A pusher assembly for engaging a fastener within a tool, the fastener moveable with respect to the tool, the pusher assembly comprising:

a runner portion having a runner adapted to be slidably coupled to the tool;

a pusher portion having a pusher extending from a first end, the pusher adapted to engage the fastener within the tool, the pusher portion rotatably coupled to the runner portion, said pusher portion including an arm extending from a second end of the pusher portion, the arm having an aperture for releasably engaging a tab disposed at a rear portion of a magazine of the tool, said second end of the pusher portion being movable to release said arm of said pusher portion from said tab; and a biasing member disposed between the runner portion and the pusher portion, the biasing member operable to bias the pusher portion into alignment with the fastener.

2. A magazine assembly for a nailer comprising:

a magazine defining a channel for receiving nails therein;

a guide member adjacent to said channel;

a pusher assembly including a runner portion slidably coupled to the guide member, a pusher adapted to engage nails within said channel, said pusher being rotatably coupled to the runner portion, and a biasing member disposed between the runner portion and the pusher and operable to bias the pusher in alignment with said channel, said pusher including an arm releasably retaining a tab disposed at a rear portion of said magazine, said pusher assembly including a push button inwardly depressible to release said pusher from said tab.

3. The magazine assembly according to claim 2, wherein said biasing member is a pusher spring.

4. A pusher assembly for engaging a fastener within a tool, the fastener moveable with respect to the tool, the pusher assembly comprising:

a runner portion having a runner adapted to be slidably coupled to the tool;

a pusher portion having a pusher extending from a first end, the pusher adapted to engage the fastener within the tool, the pusher portion rotatably coupled to the runner portion, said pusher portion including an arm extending from a second end of the pusher portion; the arm having an aperture for releasably engaging a tab disposed on a cam surface at a rear portion of a magazine of the tool, said second end of said pusher portion being movable to release said arm of said pusher portion from said tab; and a biasing member disposed between the runner portion and the pusher portion, the biasing member operable to bias the pusher portion into alignment with the fastener.

* * * * *